US010519939B2

(12) United States Patent
Apperger

(10) Patent No.: US 10,519,939 B2
(45) Date of Patent: Dec. 31, 2019

(54) HYDROSTATIC AXIAL PISTON MACHINE

(71) Applicant: Robert Bosch GmbH, Stuttgart (DE)

(72) Inventor: Andreas Apperger, Eutingen (DE)

(73) Assignee: Robert Bosch GmbH, Stuttgart (DE)

( * ) Notice: Subject to any disclaimer, the term of this patent is extended or adjusted under 35 U.S.C. 154(b) by 210 days.

(21) Appl. No.: 15/835,347

(22) Filed: Dec. 7, 2017

(65) Prior Publication Data

US 2018/0163708 A1 Jun. 14, 2018

(30) Foreign Application Priority Data

Dec. 9, 2016 (DE) ..... 10 2016 224 554

(51) Int. Cl.
*F04B 1/32* (2006.01)

(52) U.S. Cl.
CPC ..... *F04B 1/324* (2013.01); *F04B 1/126* (2013.01); *F04B 1/2035* (2013.01); *F04B 1/2042* (2013.01); *F04B 1/2078* (2013.01)

(58) Field of Classification Search
CPC ..... F04B 1/324; F04B 1/126; F04B 1/2035; F04B 1/2042; F04B 1/2078
See application file for complete search history.

(56) References Cited

U.S. PATENT DOCUMENTS 3,803,987 A * 4/1974 Knapp ..... F04B 1/324 91/506
3,877,839 A * 4/1975 Ifield ..... F04B 1/2071 417/217
5,967,123 A * 10/1999 Ruoff ..... F02M 37/04 123/495
9,518,567 B2 * 12/2016 Brehmer ..... F04B 1/328
10,072,654 B2 * 9/2018 Offenburger ..... F04B 53/109
10,233,899 B2 * 3/2019 Sauter ..... F04B 1/2078
2006/0251526 A1 * 11/2006 Belser ..... F04B 1/324 417/269
2007/0137475 A1 * 6/2007 Reimer ..... F01B 3/0002 91/505
2007/0169826 A1 * 7/2007 Hillesheim ..... G05D 16/2024 137/625.64
2014/0116242 A1 * 5/2014 Howind ..... F04B 1/32 91/374

OTHER PUBLICATIONS

Bosch Rexroth AG, Mobile Applications, RD98714 (German language) and RE98714 (English language) fact sheets, Axial piston variable motor A1OVER series 52 Reversible fan motor in open circuit, Apr. 2015, 4 pages.

* cited by examiner

*Primary Examiner* — Patrick Hamo
(74) *Attorney, Agent, or Firm* — Maginot, Moore & Beck LLP

(57) ABSTRACT

A hydrostatic axial piston machine has a housing. In the housing of the hydrostatic axial piston machine, an actuating pressure cylinder is formed at an angle to the drive shaft. A control valve is inserted into the actuating pressure cylinder in a cartridge type of design. In order to enable maximum movement of an actuating piston in the direction toward the control valve, the cartridge is of shortened design. To this end, an actuating pressure port, which is arranged between a high-pressure port and a low-pressure port, and an actuating pressure passage are arranged completely inside the cartridge.

13 Claims, 2 Drawing Sheets

HYDROSTATIC AXIAL PISTON MACHINE

This application claims priority under 35 U.S.C. § 119 to patent application number DE 10 2016 224 554.6, filed on Dec. 9, 2016 in Germany, the disclosure of which is incorporated herein by reference in its entirety.

BACKGROUND

The disclosure relates to an axial piston machine according to the following description.

Disclosed in printed document RD98714 of the application of April 2015 is a hydrostatic axial piston motor which is used as a fan motor. On account of its through-pivotability, with constant throughflow direction of the pressurized medium a reversal of the rotation direction of the output shaft of the fan motor and therefore of the fan impeller can be achieved. This serves for the blowing out of contaminants from the fan. The fan motor has electroproportional (EP) control of the pivoting angle and therefore of the rotational speed of the output shaft. A control valve and an associated electric solenoid are arranged approximately 90 degrees to a longitudinal axis of the housing or to the output shaft of the fan motor.

Also known are axial piston machines with through-pivotable swashplates and with electroproportional (EP) control, in which the control valve in a cartridge style of design is set by an angle of less than 30 degrees in relation to the longitudinal axis of the housing or to the drive shaft. The cartridge is screwed into the housing obliquely at the stated angle and via passages which are formed in the housing controls the supply to an actuating pressure chamber and therefore controls a position of an actuating piston which is coupled to the swashplate. Since the cartridge is screwed into the actuating cylinder, the actuating cylinder and the actuating pressure chamber are arranged in spatial series with the cartridge so that the cartridge limits the movement of the actuating piston in the relevant pivoting direction. Therefore, such axial piston machines are not able to pivot through from +100% to −100%.

The disclosure is based on the object of creating an electroproportionally controlled through-pivotable axial piston machine in the swashplate style of design, the pivoting range of which is extended, which can especially pivot through from +100% to −100%.

This object is achieved by means of an axial piston machine having the features described herein.

Further advantageous embodiments of the disclosure are described herein.

SUMMARY

The hydrostatic axial piston machine disclosed herein has a swashplate to which is coupled an actuating piston which can be displaced in an actuating cylinder, by means of which an inclination of the swashplate can be adjusted. The actuating cylinder is set at less than 45 degrees to a drive shaft or to a housing axis. An actuating pressure chamber which is arranged in the actuating cylinder is delimited on a side opposite the actuating piston by a cartridge of a control valve which is inserted into the actuating cylinder. Arranged between on one side a high-pressure port or pump pressure port and on the other side a low-pressure port or tank port of the control valve is an actuating pressure port of the control valve. An actuating pressure passage extends from this actuating pressure port to the actuating pressure chamber. According the disclosure, the actuating pressure passage extends directly from the actuating pressure port to the actuating pressure chamber in this case. To this end, the entire actuating pressure passage is arranged inside the cartridge. Therefore, an axial bore in the cartridge for the actuating pressure passage can be dispensed with and a saving is made in the axial overall length of the cartridge. As a result of the shortened cartridge, the actuating piston can be retracted further into the actuating cylinder, as a result of which the pivoting angle of the swashplate in this direction in question is increased, especially up to −100%. Furthermore, bores of the actuating pressure passage in the housing of the axial piston machine are dispensed with, as a result of which production effort and costs are saved.

It is especially preferred if the control valve is operated by an electric solenoid, and if the axial piston machine is electroproportionally controlled. In the case of a motor, the rotational speed of the output shaft is therefore electroproportionally controlled.

Preferably, the low-pressure port is arranged in or on a region of the cartridge which is adjacent to the actuating pressure chamber, whereas the high-pressure port is arranged in or on a region of the cartridge which is adjacent to the solenoid.

For production engineering reasons, it is simple if the actuating pressure passage is designed as a longitudinal bore in a valve spool of the control valve, wherein the valve spool extends as far as the actuating pressure chamber.

For production engineering reasons and assembly reasons it is simple if the cartridge and/or the actuating cylinder and/or the actuating pressure port and/or the high-pressure port and/or the low-pressure port and/or the valve spool and/or the longitudinal bore are concentric to the center axis. The actuating piston can be designed in such a way that a slight tilting in relation to the actuating cylinder is possible, especially if a ball joint is provided actuating piston and swashplate.

Overall length is saved and therefore the pivotability is constructionally facilitated if a feedback spring, which is mounted between the actuating piston and the end section of the valve spool, is arranged at least in a certain section in an interior space of the actuating piston (actuating piston bore).

Preferably, the feedback spring is also concentric to the center axis.

Preferably, the feedback spring, at least in the relaxed state, is longer than the interior space of the actuating piston. Therefore, assembly is simplified.

The end section of the valve spool and a spring plate which is mounted between the end section of the valve spool and the feedback spring can be inserted at least in a certain section in each case into the interior space of the actuating piston.

In particular, the end section of the valve spool and the spring plate, with a pivoting angle of −100%, are arranged in the interior space of the actuating piston.

Preferably, the spring plate is also concentric to the center axis.

In order to save further axial overall length and in order to constructionally facilitate the pivotability of up to −100%, the spring plate can be designed in such a way that the feedback spring overlaps the end section of the valve spool on the outside.

For increasing the bending safety of the feedback spring, the spring plate and the end section of the valve spool have circular cylindrical abutment sections with each other.

For simplified assembly of the spring plate on the end section of the valve spool, the spring plate preferably has an inner chamfer on its end face which is orientated toward the valve spool.

For the centering of the spring plate, an inner collar can be provided on an end face of the cartridge facing the spring plate. This is especially advantageous if the valve spool is removed for adjusting the control valve.

Preferably, the ports are annuluses. To be more precise, the actuating pressure port can be an actuating pressure annulus, and/or the high-pressure port is a high-pressure annulus, and/or the low-pressure port is a low-pressure annulus. The high-pressure annulus and the low-pressure annulus are arranged on an outer circumference of the cartridge, and/or the actuating pressure annulus is formed by a neck of the valve spool.

If the actuating pressure port is connected via a restrictor to the actuating pressure chamber, the effect of the longitudinal bore being exposed to a through-flow of an excessive amount of pressurized medium for a short period of time is prevented. Therefore, a recoil effect and a sudden pivoting through the center position are prevented, which is important especially when being used as a through-pivotable motor (cable break, faulty operation). Preferably, the restrictor is designed as a radial bore which connects the neck to the longitudinal bore.

In an especially preferred application case, the axial piston machine according to the disclosure is a fan motor. In this case, the rotational speed of the output shaft is electro-proportionally controlled. On account of the pivotability from +100% to −100%, the fan can be blown out at full rotational speed or power.

An exemplary embodiment of the axial piston machine according to the disclosure is shown in the drawings. With reference to the figures of these drawings, the disclosure is now explained in more detail.

DETAILED DESCRIPTION

Figure 1:
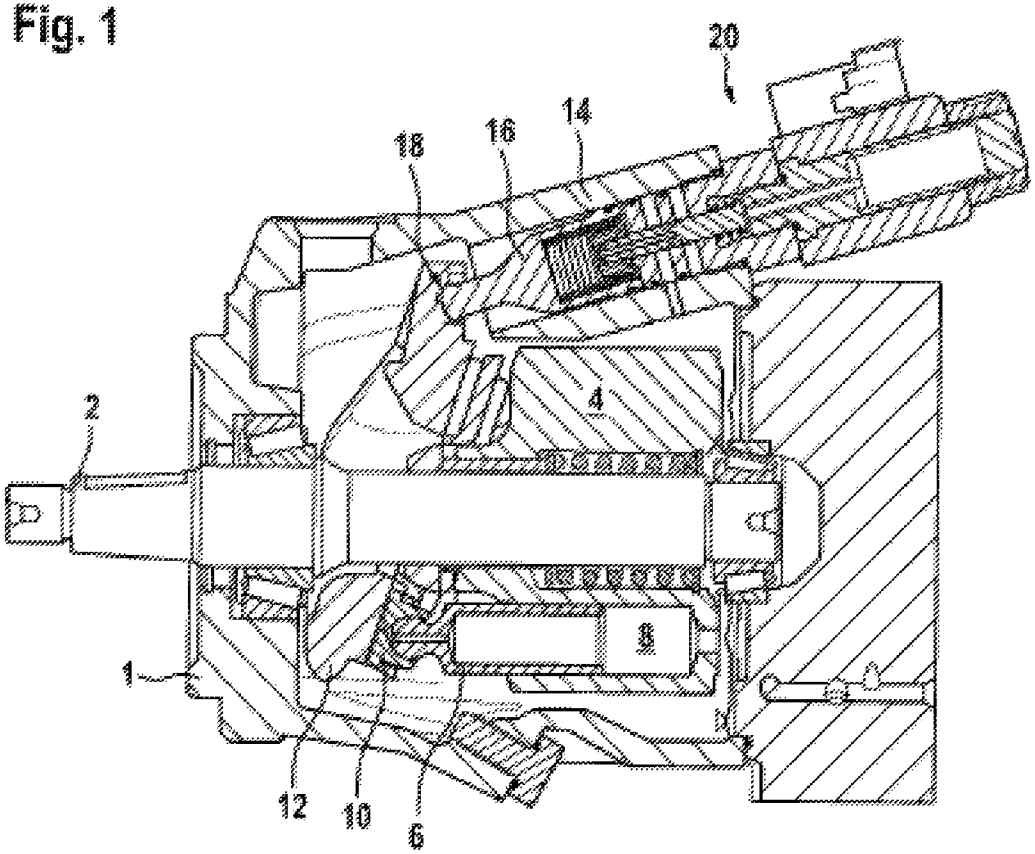
FIG. 1 shows in a longitudinal section an axial piston machine according to the disclosure according to the exemplary embodiment.

FIG. 1 shows in a longitudinal section the axial piston machine according to the disclosure with its housing 1 in which is mounted a drive shaft 2, on the outer circumference of which a cylinder drum 4 is arranged in a rotation-resistant manner. In the cylinder drum 4, pistons 6 which are distributed on the circumference are axially guided in respective cylinders 8. Formed on the end sections of the pistons 6 which project from the cylinders 8 are piston feet, on which are pivotably attached piston shoes 10 which are guided in a sliding manner on a swashplate 12 which is set at an angle to the drive shaft 2.

When the cylinder drum 4 revolves, the pistons 6 are moved out of the cylinders 8 and in again in dependence of the inclined position of the swashplate 12. Therefore, in the case of an axial piston motor, for example, the swallowing volume per revolution and therefore the rotational speed of the drive shaft 2, serving as an output shaft, can be adjusted. For controlling the inclined position of the swashplate 12, an actuating piston 16, which is guided in an actuating cylinder 14, is coupled via a ball joint 18 to the swashplate on one side.

According to the disclosure, the swashplate 12 can completely pivot through from +100% to −100%. FIG. 1 shows the −100% position of the swashplate 12, in which the actuating piston 16 is retracted into the actuating cylinder 14 to its maximal (furthest distance). In order to enable this, a control valve 20, which is also screwed into the actuating cylinder 14, is of shortened design in its overall length.

Figure 2:
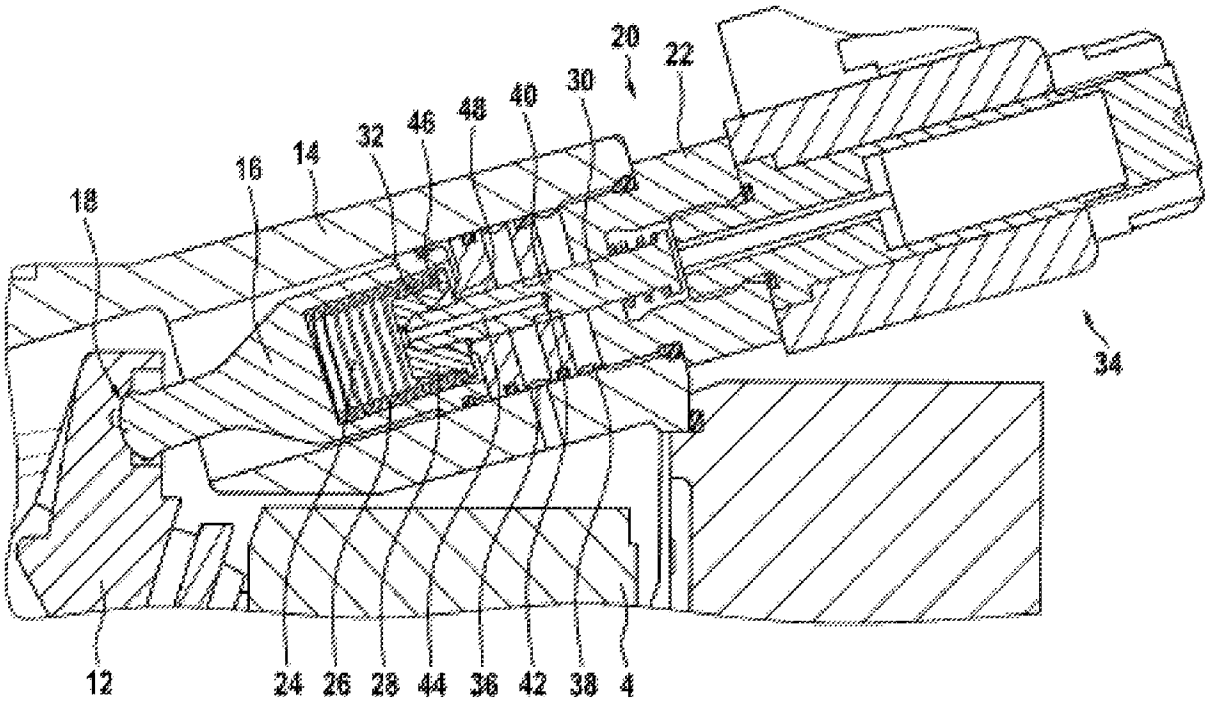
FIG. 2 shows in an enlargement a detail of the axial piston machine from FIG. 1.

FIG. 2 shows in an enlargement a detail of the axial piston machine according to the disclosure. Shown here are the actuating cylinder 14 with the actuating piston 16 guided therein, which actuating piston is also in its maximum retracted position shown in FIG. 2, as a result of which the pivoting angle of −100% is achieved. In this case, the actuating piston 16, on account of its slightly inclined position in the actuating cylinder 14 does not butt by its full extent against an end face of a cartridge 22 of the control valve 20 which is screwed into the actuating cylinder 14.

In the position shown in FIG. 2, an actuating pressure chamber 24 is reduced to an interior space of the actuating piston 16 in which a control spring or feedback spring 26 and a spring plate 28 are also accommodated. The spring plate 28 is of hat-shaped design, wherein the feedback spring 26 extends in a certain section on its outer circumference and is supported there on an edge. Formed on the inner circumference of the spring plate 28, together with an end section of a valve spool 30 which projects into the actuating pressure chamber 24, are circular cylindrical abutment sections 32. This serves for the shortening of the installation space of the arrangement and for the axial stability of the spring plate 28 in relation to the valve spool 30 and of the feedback spring 26 in relation to the two parts 28, 30.

On one side, the swashplate 12, via the actuating piston 16, the feedback spring 26 and the spring plate 28, exerts a distance-dependent feedback force upon the spool 30 of the control valve 20. On the other side, an electric solenoid acts on the valve spool 30, which solenoid can displace the valve spool 30 from its center closed position shown in FIG. 2 either into a first directed direction (to the left in FIG. 2), in which a tank port or low-pressure port 36 is connected to the actuating pressure chamber 24, or the solenoid 34 enables a movement of the valve spool 30 in an opposite directed direction (to the right in FIG. 2) in which a high-pressure port 38 is connected to the actuating pressure chamber 24. Both ports 36, 38 are designed as annular grooves on the outer circumference of the cartridge 22 and have respective radial, for example star-shaped, passages.

An actuating pressure port 40 is formed by a neck of the valve spool 30 which is delimited by two encompassing metering edges, wherein the one metering edge interacts with the radial passages of the low-pressure port 36, whereas the other metering edge interacts with the radial passages of the high-pressure port 38.

Arranged radially in the neck, which forms the actuating pressure port 40, is a comparatively narrow passage which forms a restrictor 42. The restrictor 42, via an actuating pressure passage 44 which is formed inside the valve spool 30 as a concentric longitudinal bore, is connected to the actuating pressure chamber 24. Therefore, the connection of the actuating pressure port 40 to the actuating pressure chamber 24 by the shortest path via the restrictor 42 and the actuating pressure passage 44 is arranged inside the cartridge 22, to be more precise inside the valve spool 30.

Since the actuating pressure port 40 scarcely requires axial length, the cartridge 22 according to the disclosure is comparatively short and therefore extends in the direction of the swashplate 12 only to the extent that the actuating piston 16 in its abutment position shown in FIG. 2 enables a pivoting angle of −100% of the swashplate 12.

The assembly of the arrangement shown in FIG. 2 is facilitated by the feedback spring 26 being longer in the relaxed state than the interior space of the actuating piston 16.

Formed on the inner circumference of the spring plate 28 is a chamfer 46 which facilitates insertion of the end section of the valve spool 30 into the spring plate 26.

Formed on the end face of the cartridge 22 facing the actuating piston 16, in direct proximity to the valve spool 30, is an inner collar 48 via which the spring plate 28 can be centered on account of its chamfer 46.

Disclosed is a hydrostatic axial piston machine, in the housing of which is formed, at an angle to the drive shaft, an actuating pressure cylinder into which a control valve is inserted in a cartridge type of design. In order to enable maximum movement of an actuating piston in the direction toward the control valve, the cartridge is of shortened design. To this end, an actuating pressure port, which is arranged between a high-pressure port and a low-pressure port, and an actuating pressure passage are arranged completely inside the cartridge.

LIST OF DESIGNATIONS

1 Housing
2 Drive shaft
4 Cylinder drum
6 Piston
8 Cylinder
10 Piston shoe
12 Swashplate
14 Actuating cylinder
16 Actuating piston
18 Ball joint
20 Control valve
22 Cartridge
24 Actuating pressure chamber
26 Feedback spring
28 Spring plate
30 Valve spool
32 Circular cylindrical abutment sections
34 Solenoid
36 Low-pressure port
38 High-pressure port
40 Actuating pressure port
42 Restrictor
44 Actuating pressure passage/longitudinal bore
46 Chamfer
48 Inner collar

What is claimed is:

1. A hydrostatic axial piston machine comprising:

a swashplate;

an actuating piston coupled to the swashplate, the actuating piston configured to be displaced in an actuating cylinder and configured to adjust an inclination of the swashplate, wherein:

an actuating pressure chamber, which is arranged in the actuating cylinder, is delimited by a cartridge of a control valve which is inserted into the actuating cylinder, an actuating pressure port of the control valve is arranged between a high-pressure port and a low-pressure port of the control valve, an actuating pressure passage extends from the actuating pressure port to the actuating pressure chamber, and the actuating pressure passage is arranged inside the cartridge.

2. The axial piston machine according to claim 1, wherein:

the low-pressure port is arranged in or on a region of the cartridge which is adjacent to the actuating pressure chamber, and the high-pressure port is arranged in or on a region of the cartridge which is adjacent to a solenoid.

3. The axial piston machine according to claim 1, wherein the actuating pressure passage is a longitudinal bore in a spool of the control valve.

4. The axial piston machine according to claim 3, wherein:

a feedback spring is mounted between the actuating piston and an end section of the spool, and the feedback spring is arranged at least in a certain section in an interior space of the actuating piston.

5. The axial piston machine according to claim 4, wherein the feedback spring, at least in a relaxed state, is longer than the interior space of the actuating piston.

6. The axial piston machine according to claim 4, wherein the end section of the spool and a spring plate, which is mounted between the end section of the spool and the feedback spring, are configured to be inserted at least in a certain section into the interior of the actuating piston.

7. The axial piston machine according to claim 6, wherein the spring plate is configured such that the feedback spring overlaps the end section of the spool on an outside.

8. The axial piston machine according to claim 6, wherein the spring plate and the end section of the spool have circular cylindrical abutment sections with each other.

9. The axial piston machine according to claim 6, wherein the spring plate on its side orientated toward the spool has an inner chamfer.

10. The axial piston machine according to claim 6, wherein an end face of the cartridge facing the spring plate has an inner collar.

11. The axial piston machine according to claim 3, wherein:

the actuating pressure port is an actuating pressure annulus, and/or wherein the high-pressure port is a high-pressure annulus, and/or wherein the low-pressure port is a low-pressure annulus, wherein the high-pressure annulus and the low-pressure annulus are arranged on an outer circumference of the cartridge, and/or wherein the operating pressure annulus is formed by a neck of the spool.

12. The axial piston machine according to claim 11, wherein the neck is connected via a restrictor to the longitudinal bore.

13. The axial piston machine according to claim 1, wherein the axial piston machine is a fan motor.

* * * * *